US006722454B2

(12) United States Patent
Mocivnik et al.

(10) Patent No.: US 6,722,454 B2
(45) Date of Patent: Apr. 20, 2004

(54) DEVICE FOR DRILLING, IN PARTICULAR PERCUSSION DRILLING OR ROTARY PERCUSSION DRILLING, BOREHOLES

(75) Inventors: Josef Mocivnik, Fohnsdorf (AT); Karl Bonm, Ansfelden (AT)

(73) Assignees: Techmo Entwicklungs- und Vertriebs GmbH, Fohnsdorf (AT); "ALWAG" Tunnelausbau Gesellschaft m.b.H., Pasching (AT)

( * ) Notice: Subject to any disclaimer, the term of this patent is extended or adjusted under 35 U.S.C. 154(b) by 0 days.

(21) Appl. No.: 10/226,139

(22) Filed: Aug. 23, 2002

(65) Prior Publication Data

US 2003/0079915 A1 May 1, 2003

Related U.S. Application Data

(63) Continuation of application No. PCT/AT01/00044, filed on Feb. 21, 2001.

(30) Foreign Application Priority Data

Feb. 24, 2000 (AT) ..... A 289/2000

(51) Int. Cl.[7] ..... E21B 4/16

(52) U.S. Cl. ..... 175/171; 175/257; 175/305

(58) Field of Search ..... 175/418, 417, 175/415, 257, 262, 293, 305, 393, 414, 171

(56) References Cited

U.S. PATENT DOCUMENTS

| | | | | | |
|---|---|---|---|---|---|
| 2,746,721 | A | * | 5/1956 | Moore | 175/393 |
| 3,382,934 | A | | 5/1968 | Spear | 175/171 |
| 5,033,556 | A | * | 7/1991 | Panzke | 175/171 |
| 6,106,200 | A | * | 8/2000 | Mocivnik et al. | 175/257 |

FOREIGN PATENT DOCUMENTS

| | | | |
|---|---|---|---|
| AT | 390303 | B | 4/1990 |
| DE | 4006320 | C1 | 10/1991 |
| DE | 4432710 | C1 | 4/1996 |
| EP | 0670950 | B1 | 10/1997 |
| WO | WO98/20229 | | 5/1998 |
| WO | WO98/21439 | | 5/1998 |

* cited by examiner

*Primary Examiner*—David Bagnell
*Assistant Examiner*—Matthew J Smith
(74) *Attorney, Agent, or Firm*—Jacobson Holman PLLC

(57) ABSTRACT

A device for drilling holes, including a drill bit with a drilling or breaking surface, a drill rod for introducing a rotary or percussive force and for introducing a rinsing or cooling fluid into the drill bit and a sheath pipe which defines a hollow space between the drill rod and the inside of the sheath pipe and which is supported on the drill rod or which can be connected to the drill bit. In a drilling position, the sheath pipe is situated at a distance from the rear side of the drill bit facing away from the breaking surface and the drill bit can be introduced into a rinsing position for the hollow space between the sheath pipe and the drill rod with its rear side resting on the front end of the sheath pipe facing towards the drill bit or can be connected to the front end of the sheath pipe.

6 Claims, 2 Drawing Sheets

Figure 1:
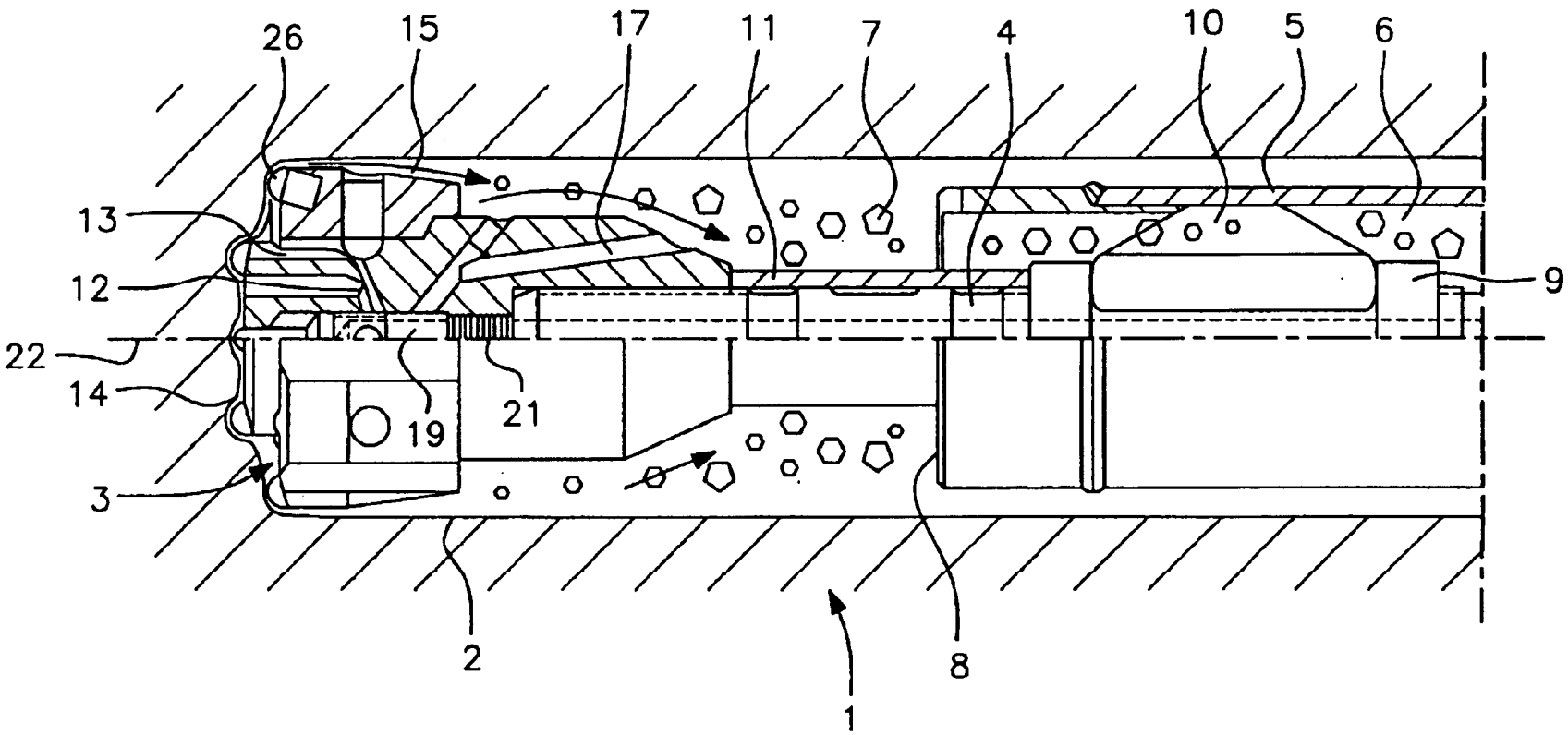

DEVICE FOR DRILLING, IN PARTICULAR PERCUSSION DRILLING OR ROTARY PERCUSSION DRILLING, BOREHOLES

The present application is a continuation application of PCT/AT01/00044, filed on Feb. 21, 2001.

FIELD OF THE INVENTION

The present invention relates to a device for drilling, in particular percussion drilling or rotary percussion drilling, boreholes, including a drill bit having a drilling or working surface, a drill rod assembly for introducing a rotation and/or percussion stress and for introducing a flushing and cooling fluid into the drill bit, and a jacket tube which defines a hollow space between the drill rod assembly and the interior of the jacket tube and is supported on the drill rod assembly and connectable with the drill bit, wherein the jacket tube in a drilling position is arranged at a distance from the drill bit rear side facing away from the working surface.

DESCRIPTION OF THE PRIOR ART

Such devices for drilling, in particular percussion drilling or rotary percussion drilling, boreholes are known in various embodiments, whereby the haulage of the excavated material or drillings has to be ensured in any event. Embodiments of such drilling devices are known, wherein, in a modification of the initially defined embodiment, no jacket tube or cladding tube is used such that the haulage of the excavated material may simply be effected in a free space provided around the drill rod assembly, the drill rod assembly usually having smaller external dimensions than the drill bit defining or making the borehole.

A device according to the type mentioned above can be taken for: example from DE-C 40 06 320, aiming in particular at providing of boreholes with tubes. DE-C 44 32 710 discloses a target drilling device for horizontal drilling aiming at a proper drilling through obstacles.

In an embodiment of the initially defined kind, in which a jacket tube or cladding tube is used in addition, the haulage of the excavated material or drillings may be effected outside the jacket tube, if the latter has an accordingly reduced external diameter relative to the drill bit, whereby, however, only comparatively small free spaces will usually be formed in such cases such that only relatively small size excavated material can be transported off in those regions. Since in devices of the initially defined kind jacket tubes are usually used whose external dimensions differ only slightly from the external dimensions of the drill bit because the jacket tube is to provide an at least partial support or provisional lining of the borehole, in particular in the case of broken rocks, the haulage of excavated material or drillings in such devices in which a comparatively large passage is defined between the drill rod assembly and the interior of the jacket tube is effected through that free space or hollow space or annular space provided between the drill rod assembly and the interior of the jacket tube, reference in this context being made, for instance, to AT-B 390 303, EP-B 0 670 950 or WO 98/20229. In addition to the usually known passage openings provided for a flushing and cooling fluid, which are located in the foremost section or on the working surface of the drill bit, at least one further passage opening must, however, be usually provided in those known embodiments, either on the working surface of the drill bit or in a lateral portion thereof, in order to enable the introduction of the excavated material or drillings to be transported off, into the free space or hollow space defined by the drill rod assembly and the interior of the jacket tube, and subsequently enable the delivery of the excavated material through that hollow space. It is immediately apparent that in such a manner only very small size material can be transported off, since it is feasible to provide only comparatively small passage openings in the region of the drill bit and in a consecutive region between the drill bit and the jacket tube in order to enable the introduction of excavated material into the hollow space provided between the drill rod assembly and the jacket tube. Moreover, there is a great risk of obstructions of such passage openings which may give rise to haulage problems of, in particular lumpy or granular, excavated material and call for a further disintegration of the already excavated material in order to enable its introduction and passage through the passage openings in the region of the drill bit for removing the same, wherein it is immediately apparent that such an additional disintegration work to be performed by the drill bit will decelerate the drilling progress as a whole.

SUMMARY OF THE INVENTION

Departing from a device of the initially defined kind, the present invention aims to provide a device for drilling, in particular percussion drilling or rotary percussion drilling, boreholes, which facilitates the haulage of excavated material or drillings known per se, through a hollow space or annular space defined by the drill rod assembly and the interior of the drill rod and which enables excavated material, in particular excavated material having also larger dimensions to be readily introduced into, and delivered through, that hollow space or annular space.

To solve these objects, the device for drilling, in particular percussion drilling or rotary percussion drilling, boreholes is essentially characterized in that the drill bit in a flushing position for the hollow space provided between the jacket tube and the drill rod assembly is placeable with its rear side in abutment on the jacket tube front end facing the drill bit and/or connectable with the front end of the jacket tube and that a locking element is provided in the interior of the drill bit, which, in the drilling position, clears at least one passage opening ending in the working surface and, in the flushing position, for discharging the flushing fluid into the interior of the hollow space between the jacket tube and the drill rod assembly, clears at least one passage opening leading towards the rear side. Due to the fact that the jacket tube in a drilling position is arranged at a distance from the drill bit, a free space is made available behind the drill bit, viewed from the working surface of the drill bit, which free space leaves an accordingly large passage opening for the introduction of the excavated material or drillings into the hollow space or annular space provided between the drill rod assembly and the jacket tube so as to enable comparatively coarse material tuned to the dimensions of this jacket tube to be readily introduced into the hollow space and transported off through the same. Thus, as opposed to the initially discussed known prior art, the device according to the invention does not require additional passage openings in the region of the working surface of the drill bit, or in a lateral region thereof, in order to enable the introduction of excavated material behind the drill bit and into the hollow space defined between the drill rod assembly and the interior of the jacket tube, so that weakening of the drill bit will be avoided and the obstructions and blockages occurring at those haulage openings in the known embodiments need not be feared, in particular. It is, thus, feasible in the region of the working surface to do with the known passage openings for the cooling and flushing fluid, which are usually provided in comparatively smaller numbers and have comparatively smaller passage cross sections, too. In order to enable flushing or the selective haulage of the material to be transported off in the annular space or hollow space provided between the drill rod assembly and the interior of the jacket tube, it is, furthermore, provided, according to the invention, that the rear side of the drill bit in such a flushing position is placeable in abutment on the jacket tube front end facing the drill bit and/or connectable with the front end of the jacket tube so as to immediately enable the selective and defined flushing of this hollow space or annular space by the introduction of the cooling or flushing fluid also into this annular space or hollow space. In order to ensure, in case at least one additional passage opening is provided in the region of the rear side of the drill bit, that this passage opening will be activated only in the flushing position of the device according to the invention, allowing for the discharging of a flushing and cooling fluid only in the flushing position, it is, furthermore, proposed according to the invention that a locking element is provided in the interior of the drill bit, which, in the drilling position, clears at least one passage opening ending in the working surface and, in the flushing position, for discharging the flushing fluid into the interior of the hollow space between the jacket tube and the drill rod assembly clears at least one passage opening leading towards the rear side.

As already pointed out above, the device according to the invention requires only a comparatively small number of passage openings on the working surface of the drill bit for discharging flushing and cooling fluid, wherein, in order to enable the simple flushing of the jacket tube between the drill rod assembly and the jacket tube, it is contemplated that the drill bit each comprises at least one passage opening for discharging the flushing fluid in the region of the working surface and a passage opening ending in the region of the rear side of the drill bit. Such an additional passage opening ending in the region of the rear side of the drill bit, in the flushing position in which the drill bit is in abutment on the front end of the jacket tube and/or connected therewith, enables the selective and safe introduction of the flushing fluid into the interior of the hollow space, whereby the cleansing and flushing effect sought may be reliably maintained with a comparatively small amount of fluid.

In order to afford a particularly small-structured embodiment of the locking element to be safely operated, it is preferably provided in this respect that the locking element is formed by a bush guided in the interior of the drill bit and surrounding a flushing fluid supply duct extending substantially centrally, said bush in the drilling position being displaceable within the drill bit in the longitudinal direction thereof against the force of a spring, by means of a plug or pin member projecting from the working surface. Such a bush-like locking element may be designed accordingly sturdy and small-structured so as to ensure a reliable mode of operation over extended periods of time even under the rough operating conditions prevailing within a borehole. Furthermore, the plug or pin member projecting from the working or drilling surface ensures the automatic lock and release of the respectively desired passage opening(s) in the region of the working surface of the drill bit or in the region of its rear side in the flushing position, because with the retraction of the drill bit into abutment on the jacket tube in order to assume the flushing position the working surface of the drill bit is disengaged from the worked off front face of the borehole, thus allowing for the automatic displacement of the bush-like locking element against the spring force so as to release only those passage opening(s) which are provided on the rear side of the drill bit.

In order to enable the provision of a substantially tight closure between the drill bit and, in particular, its rear side facing away from the working surface and the jacket tube front end facing the drill bit, it is contemplated according to another preferred embodiment that the jacket tube, on its front end facing the drill bit, defines a free space between the drill rod assembly and its interior for the at least partial overlapping of the drill bit end facing away from the working surface, so that in such a position any further penetration of excavated material into this consecutive region between the drill bit and the tube will be safely avoided and no such blockages need be feared during any further use of the drill bit.

In order to avoid an obstruction by extremely coarse-grained or lumpy excavated material, of the entry opening of the hollow space or annular space defined between the drill rod assembly and the interior of the jacket tube, which entry opening has a comparatively large passage cross section, it is contemplated according to a further preferred embodiment that a sleeve element is provided on the external periphery of the drill rod assembly and/or the jacket tube for delimiting the free passage cross section on the front end of the jacket tube. Such a sleeve element may be tuned to passage cross sectional limitations or constrictions to be optionally provided in the interior of the jacket tube, which may occur, for instance, in the region of connection pieces between the individual parts of the drill rod assembly and/or the jacket tube, so as to ensure in each case that even with a comparatively large entry opening into the hollow space between the drill rod assembly and the jacket tube any blockage or obstruction by larger excavated material pieces will be safely avoided in the interior of the jacket tube.

Depending on the purpose of use and on the material to be worked, the device according to the invention, moreover, is preferably devised such that the flushing fluid is comprised of compressed air or a liquid, in particular water, under pressure.

Particularly simple coupling of a drill bit with a jacket tube surrounding the drill rod assembly will, moreover, be ensured in that the drill bit is subdivided into a central inner part and an outer part annularly surrounding the inner part and coupled therewith, in particular in a detachable manner, as in correspondence with a further preferred embodiment of the device according to the invention.

SHORT DESCRIPTION OF THE DRAWINGS

Figure 2:
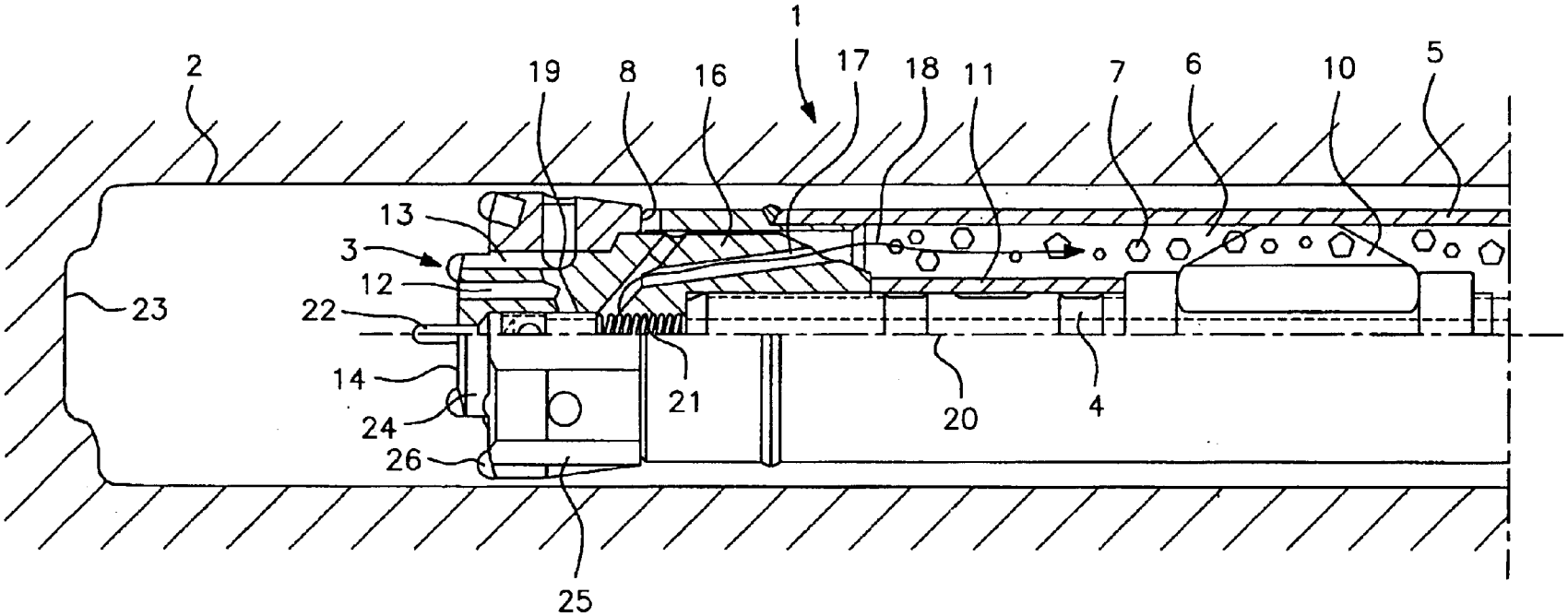

In the following, the invention will be explained in more detail by way of exemplary embodiments schematically illustrated in the drawing. Therein:

FIG. 1 is a schematic, partially sectioned illustration through a device according to the invention in the drilling position; and FIG. 2 is also a schematic, partially sectioned illustration similar to that of FIG. 1, through the device according to the invention in the flushing position.

DESCRIPTION OF PREFERRED EMBODIMENTS

In FIGS. 1 and 2, a device for drilling, in particular percussion drilling or rotary percussion drilling, a borehole schematically illustrated at 2 is generally denoted by 1, which device 1 comprises a drill bit generally denoted by 3, a drill rod assembly 4 and a jacket tube 5 surrounding the drill rod assembly, wherein a hollow space or annular space 6 is defined between the drill rod assembly 4 and the interior of the jacket tube 5. As is apparent from the drawing, excavated lumpy material or drillings 7 are transported off through the annular space or hollow space 6 defined between the external periphery of the drill rod assembly 4 and the internal diameter or interior of the jacket tube 5. In the drilling position represented in FIG. 1 it is shown that in the drilling position the front end 8 of the jacket tube 5 facing the drill bit 3 is located at a distance from the rear side of the drill bit 3 such that a large free space is available for the excavated material led past the drill bit 3 to be introduced into the hollow space 6 defined between the drill rod assembly 4 and the jacket tube 5. It is apparent from FIG. 1 that even comparatively large-size material 7 may, thus, be introduced into that annular space or hollow space 6.

In the region of the drill rod assembly 4, a connection zone is, furthermore, indicated at 9 in FIG. 1, it being apparent that this connection zone 9 of, for instance, individual sections of the drill rod assembly has an external diameter that is larger than that of the remaining drill rod assembly 4, wherein an additional support of the jacket tube 5, which usually has a comparatively small thickness, in those regions is indicated by 10. In order to avoid blockage during the introduction of very large material pieces 7, particularly in such a partial zone 9, a sleeve element 11 is schematically indicated in FIG. 1, which, adjacent the rear side of the drill bit 3, constricts the free entry gap or entry cross section into the hollow space 6 in order to enable only accordingly smaller material particles 7 to enter that hollow space 6 so as to reliably avoid jamming or locking of the same in the interior of the hollow space 6, for instance in the region of the connection elements 9. It is immediately apparent that tuning to possibly differing dimensions of connection pieces 9 is feasible by dimensioning the sleeve 11 accordingly.

In the drilling position depicted in FIG. 1, a flushing and cooling fluid introduced in a known manner into the region of the drill bit 3 through the interior of the drill rod assembly 4 is discharged via passage openings provided at the drilling or working surface 14 of the drill bit 3 and schematically denoted by 12 and 13, thus effecting, on the one hand, the flushing and cooling of the working surface 14 and, on the other hand, the activation and entrainment into the hollow space 6 according to arrows 15, of the excavated material 7 due to the recirculation, beside the drill bit 13, of the flushing and cooling fluid usually introduced under pressure and optionally comprised of compressed air or, for instance, water under pressure, so as to effect the directional haulage of the excavated material or drillings 7 through the hollow space 6, supported by the flushing fluid.

In case a flushing of the hollow space 6 or the complete removal of the excavated material or drillings 7 contained therein is to be effected, the drill bit 7 may simply be retracted into the jacket tube 5 or in abutment on the same, i.e., into the flushing position illustrated in FIG. 2, so as to cause the jacket tube front side 8 facing the drill bit 3 to get into abutment on the rear side of the drill bit and a rear part 16 of the drill bit 3 to be overlapped by the front end 3 of the jacket tube 5. To this end, an appropriate free space is provided in the region of the front end 8 of the jacket tube 4.

Furthermore, it is apparent from FIG. 2 that, instead of discharging the flushing and cooling fluid introduced into the drill bit 3 via the drill rod assembly 4, through the passage openings 12 and 13 ending in the working surface 14, at least one further passage opening 17 is provided on the rear side 16 of the drill bit, via which discharging of the flushing and cooling fluid is effected directly into the hollow space 6 provided between the drill rod assembly 4 and the interior of the jacket tube 5 according to arrow 18. In the position illustrated in FIG. 2, the clear fluid passage toward the passage openings 12 and 13 in that case is blocked by a bush-like locking element 19 which is displaceable in the longitudinal direction 20 of the drilling device 1 against the force of a spring 21 such that the flushing and cooling fluid, in the flushing position illustrated in FIG. 2, enters the at least one passage opening 17 facing the rear side of the drill bit 3 directly from a supply bore extending substantially centrally within the drill rod assembly 4. The bush-like locking element 19, furthermore, is coupled with a plug or pin member 22 which, in the flushing position illustrated in FIG. 2, projects beyond the working surface 14, whereas, in the drilling position illustrated in FIG. 1, it gets into abutment on the material 23 to be excavated and hence displaces the bush-like locking element 19 against the force of the spring 21 into the position illustrated in FIG. 1 in which the passage opening 17 is locked by the locking element 19 and again allows cooling fluid discharging merely through the passage openings 12 and 13 facing the working surface 14.

In the embodiment represented in the drawing, it is to be seen, in addition, that the drill bit 3 is substantially subdivided into a central middle part 24 and an annular external part 25 surrounding the former, excavation tools or elements comprised of, for instance, pin-like hard-material inserts being each indicated by 26.

The device 1 illustrated, thus, enables the safe haulage even of coarse material or drillings 7 in conformity with a hollow space 6 providing a comparatively large passage cross section between the drill rod assembly 4 and the jacket tube 5, whereby additional passage openings that enable the recirculation of material as provided by the prior art need not be arranged in the drill bit 3. Besides, by rendering feasible the haulage of coarse material or drillings 7, the percussion or excavation energy introduced through the drill rod assembly 4 can be used entirely for the production of the borehole 2 and need not be applied to any further disintegration of the excavated material in order to enable the same to be transported off through the passage openings provided in the drill bit 3, as is required in the prior art.

What is claimed is:

1. A device for drilling, boreholes by one of percussion drilling and rotary percussion drilling, said device comprising a drill bit having a drilling or working surface, a drill rod assembly for introducing at least one of a rotation and percussion stress and for introducing a flushing and cooling fluid into the drill bit, a jacket tube defining a hollow space between the drill rod assembly and an interior of the jacket tube for removal of excavated material therebetween and the jacket tube being supported on the drill rod assembly and being connectable with the drill bit, the jacket tube in a drilling position being arranged at a distance from a rear side of the drill bit facing away from the working surface, the drill bit in a flushing position for flushing the hollow space provided between the jacket tube and the drill rod assembly being placeable with the rear side of the drill bit in contact with a front end of the jacket tube facing the drill bit, and a locking element provided in an interior of the drill bit, the locking element, in the drilling position, clears at least one passage opening of the drill bit ending in the working surface for passage of the flushing fluid to the working surface and, in the flushing position, the locking element being moved to divert the flushing fluid from the working surface into an interior of the hollow space between the jacket tube and the drill rod assembly for passage of the flushing fluid to the hollow space so as to remove excavated material in the hollow space.

2. The device according to claim 1, wherein the flushing fluid is comprised of one of compressed air and water, under pressure.

3. The device according to claim 1, wherein the drill bit is subdivided into a central inner part and an outer part annularly surrounding the inner part and coupled therewith.

4. A device for drilling boreholes by one of percussion drilling and rotary percussion drilling, said device comprising a drill bit having a drilling or working surface, a drill rod assembly for introducing at least one of a rotation and percussion stress and for introducing a flushing and cooling fluid into the drill bit, a jacket tube defining a hollow space between the drill rod assembly and an interior of the jacket tube and the jacket tube being supported on the drill rod assembly and being connectable with the drill bit, the jacket tube in a drilling position being arranged at a distance from a rear side of the drill bit facing away from the working surface, the drill bit in a flushing position for flushing the hollow space provided between the jacket tube and the drill rod assembly being placeable with the rear side of the drill bit in contact with a front end of the jacket tube facing the drill bit, and a locking element provided in an interior of the drill bit, the locking element, in the drilling position, clears at least one passage opening of the drill bit ending in the working surface and, in the flushing position, discharging the flushing fluid into an interior of the hollow space between the jacket tube and the drill rod assembly, the locking element being formed by a bush guided in an interior of the drill bit and surrounding a flushing fluid supply duct extending substantially centrally within the drill bit, said bush in the drilling position being displaceable within the drill bit in the longitudinal direction thereof against the force of a spring, by a plug or pin member projecting from the working surface.

5. A device for drilling boreholes by one of percussion drilling and rotary percussion drilling, said device comprising a drill bit having a drilling or working surface, a drill rod assembly for introducing at least one of a rotation and percussion stress and for introducing a flushing and cooling fluid into the drill bit, a jacket tube defining a hollow space between the drill rod assembly and an interior of the jacket tube and the jacket tube being supported on the drill rod assembly and being connectable with the drill bit, the jacket tube in a drilling position being arranged at a distance from a rear side of the drill bit facing away from the working surface, the drill bit in a flushing position for flushing the hollow space provided between the jacket tube and the drill rod assembly being placeable with the rear side of the drill bit in contact with a front end of the jacket tube facing the drill bit, and a locking element provided in an interior of the drill bit, the locking element, in the drilling position, clears at least one passage opening of the drill bit ending in the working surface and, in the flushing position, discharging the flushing fluid into an interior of the hollow space between the jacket tube and the drill rod assembly, the jacket tube, on a front end facing the drill bit, defining a free space between the drill rod assembly and the interior of the jacket tube for the at least partial overlapping of the drill bit end facing away from the working surface.

6. A device for drilling boreholes by one of percussion drilling and rotary percussion drilling, said device comprising a drill bit having a drilling or working surface, a drill rod assembly for introducing at least one of a rotation and percussion stress and for introducing a flushing and cooling fluid into the drill bit, a jacket tube defining a hollow space between the drill rod assembly and an interior of the jacket tube and the jacket tube being supported on the drill rod assembly and being connectable with the drill bit, the jacket tube in a drilling position being arranged at a distance from a rear side of the drill bit facing away from the working surface, the drill bit in a flushing position for flushing the hollow space provided between the jacket tube and the drill rod assembly being placeable with the rear side of the drill bit in contact with a front end of the jacket tube facing the drill bit, a locking element provided in an interior of the drill bit, the locking element, in the drilling position, clears at least one passage opening of the drill bit ending in the working surface and, in the flushing position, discharging the flushing fluid into an interior of the hollow space between the jacket tube and the drill rod assembly, and a sleeve element provided on at least one of an external periphery of the drill rod assembly and the jacket tube for delimiting the free passage cross section on the front end of the jacket tube.

* * * * *